US006444916B2

(12) United States Patent
Tamura et al.

(10) Patent No.: US 6,444,916 B2
(45) Date of Patent: Sep. 3, 2002

(54) SELF-BONDING INSULATED WIRE AND SELF-BONDING LITZ WIRE COMPRISING THE SAME

(75) Inventors: Kazushige Tamura, Otsu; Fusamori Araki, Jyoyo; Seiichi Nagamine, Otsu, all of (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 09/818,655

(22) Filed: Mar. 28, 2001

(30) Foreign Application Priority Data

Mar. 31, 2000 (JP) ..... 2000-096161
Apr. 20, 2000 (JP) ..... 2000-118881

(51) Int. Cl.[7] ..... H01B 7/00
(52) U.S. Cl. ..... 174/110 R
(58) Field of Search ..... 174/110 R, 120 R, 174/110 N, 110 SR; 428/375, 378, 379, 383

(56) References Cited

U.S. PATENT DOCUMENTS 4,420,536 A * 12/1983 Saunders et al. ..... 174/110 N
4,546,210 A * 10/1985 Akiba et al. ..... 174/114 R
6,231,979 B1 * 5/2001 Nagamine et al. ..... 174/110 N

FOREIGN PATENT DOCUMENTS

| | | |
|---|---|---|
| EP | 0 881 646 A1 | 12/1998 |
| JP | 05-059329 | 3/1993 |
| JP | 05-225831 | 9/1993 |
| JP | 08-017251 | 1/1996 |
| JP | 11-306865 | 11/1999 |
| WO | WO 98/22955 * | 5/1998 |

* cited by examiner

*Primary Examiner*—Chau N. Nguyen
(74) *Attorney, Agent, or Firm*—Armstrong, Westerman & Hattori, LLP.

(57) ABSTRACT

A self-bonding insulated wire having a bonding layer on an insulated wire, the bonding layer including a crystalline copolyamide having a melting point within the range of 105 to 150° C. and a relative viscosity of 1.4 to 1.6 measured at 25° C. with respect to a 0.5% by weight m-cresol solution thereof, and optionally at least one member selected from the group of a high-melting nylon having a melting point within the range of 200 to 300° C. and an antioxidant. The bonding layer can be formed from a coating having an increased resin concentration and the residual solvent content of the bonding layer is small. The self-bonding insulated wire and self-bonding litz wire composed thereof provide deflecting coils having a decreased strain, good adhesive property and good heat resistance.

20 Claims, 3 Drawing Sheets

SELF-BONDING INSULATED WIRE AND SELF-BONDING LITZ WIRE COMPRISING THE SAME

BACKGROUND OF THE INVENTION

The present invention relates to a self-bonding insulated wire suitable for the production of deflecting yoke coil for use in television receiver, computer display and the like, and a self-bonding litz wire comprising it.

A self-bonding insulated wire has a bonding layer as the outermost layer. The self-bonding insulated wire is coiled around a mold and the outermost bonding layer is melted or swollen by electric heating or solvent treatment, whereby the adjacent wires can be adhered and solidified to form an integrated body. Therefore, self-supporting coils can be easily prepared therefrom. Like this, since the self-bonding insulated wire can improve the productivity of coils for use in electrical machinery and apparatus and can reduce the production cost, it has been popularly used in coils of household electric appliances, office automation machines, electric fixtures and accessories, deflecting yokes for CRT display, and the like.

In recent years, CRT display device is advanced in miniaturization, improvement of heat resistance, high voltage application and high frequency application. Therefore, the deflecting yoke coil which is an important part of the CRT display device, is required to be small in dimensional change at ordinary and high temperatures and in initial strain (which is a difference between the size of coil and the size of a mold for coiling and is evaluated by measuring the neck diameter of coil and the amount of torsion) observed when forming a coil by winding a wire around a coiling mold and subjecting the wound wire to melt-adhesion of the adjacent wires.

To meet these requirements, self-bonding insulated wires are required to have excellent heat distortion resistance and adhesive strength at both ordinary temperature and high temperature.

Also, recently, in order to reduce heat generation of coil per se by eddy-current loss and skin effect loss in deflecting yoke coil resulting from high resolution and high frequency application to CRT display, use of self-bonding litz wire wherein self-bonding insulated wires with small conductor size are stranded is becoming popular.

An epoxy resin (phenoxy resin) has been conventionally used as a melt-adhesive resin for forming the bonding layer of the self-bonding insulated wire, but recently is used a copolyamide which has well-balanced heat resistance and adhesive property.

The self-bonding insulated wires have been generally prepared by repeatedly applying and baking an insulating coating, e.g., polyester imide coating, polyester imide urethane coating or polyurethane coating, onto a conductor in plural times to give an insulated wire, applying onto the insulated wire a coating wherein a melt-adhesive resin such as a copolyamide resin is dissolved in a solvent such as cresol or an aromatic naphtha, by dies, placing the coated wire in a baking oven and evaporating the solvent to form a melt-bonding layer on the insulation layer. This method has the advantages that any resins can be used as a melt-adhesive coating so long as they are soluble in solvents and viscosity reduction required when applying the coating onto insulated wires is possible.

In melt-adhesive coatings conventionally used for the preparation of self-bonding insulated wires is used a large amount of a solvent over 85% by weight in order to reduce the viscosity to thereby achieve a good coating workability. However, the solvent per se is of course an unnecessary component for the bonding layer and is evaporated in a baking oven in a baking step during the preparation of self-bonding insulated wires. The use of a large amount of a solvent is also disadvantageous in that the concentration of the effective film-forming component for forming the bonding layer becomes low and, therefore, the thickness of the film formed by one coating-baking operation is thin. Thus, the coating-baking operation must be repeated multiple times to form the bonding layer having a desired thickness. It is very uneconomical.

Further, in recent years, resources saving and energy saving are strongly demanded, and effective utilization of resources is important. The effective utilization of resources would also bring a favorable result to environmental pollution problem.

In light of the above, if the amount of a solvent in the melt-adhesive coatings can be decreased, it would be very advantageous in economy and productivity and would be effective for resources saving and environmental pollution prevention.

Phenolic organic solvents such as cresol are generally used in conventional melt-adhesive coatings. The conventional melt-adhesive coatings also have the problem that since the amount of such phenolic solvents is large, evaporation of the solvents in the baking step is apt to become insufficient, so a trace amount of the solvents remains in the bonding layer (the amount of residual solvents being at least about 1.0% by weight based on the weight of the bonding layer of the self-bonding insulated wire). The residual solvents cause the problem that they evaporate during electrical heating in the coiling working. Since the phenolic organic solvents such as cresol are harmful from the viewpoints of odor and environment, it is desirable to decrease the residual solvents in the bonding layer as much as possible.

In order to solve the residual solvent problem, JP-A-8-17251 proposes to use benzyl alcohol as the solvent of the melt-adhesive coatings. However, benzyl alcohol is expensive and accordingly is not practicable.

Another method is to decrease the amount of a solvent to be used in the melt-adhesive coatings so as to increase the concentration of a resin. In this case, the residual solvent problem would be solved, but the wire preparation becomes difficult since the viscosity of the melt-adhesive coatings is high at usual coating temperature. Therefore, in case of using melt-adhesive coatings having a high resin concentration, the coatings must be applied at an elevated temperature to obtain a viscosity suitable for the application. However, in this case, the solvent evaporates from the melt-adhesive coatings during the application and, therefore, not only the working environment is deteriorated, but also the viscosity increases with the lapse of time to finally make the application operation difficult.

In order to solve the problem encountered when using melt-adhesive coatings having a high resin concentration, it is proposed to decrease the molecular weight (relative viscosity) of a copolyamide resin to be used in the coatings. Since the viscosity of the coatings can be lowered by this method, it is possible to achieve a high resin concentration. However, coils molded from a self-bonding insulated wire having a bonding layer of a low molecular weight copolyamide or a litz wire made thereof have the problems not only that the initial strain is large, the heat distortion resistance at ordinary and high temperatures is inferior and the adhesive strength is low, but also that when the coils are used in deflecting yoke or the like, the adhesive strength between the wires is lowered by a heat generated at the time of use. The coils having a lowered adhesive strength are easy to become loose, resulting in a cause of misconvergence of displayed image.

As a means to solve such a problem, for example, JP-A-5-59329 discloses that a tough film is obtained by preparing a coating solution containing as a main component a polyamide having a terminal carboxyl group and a terminal amino group in a ratio of 1:4 to 4:1 by mole and having a relative viscosity of not more than 1.8 measured at 25° C. with respect to a 0.5% by weight cresol solution thereof, applying the coating solution onto a substrate and thermally polymerize the polyamide during or after drying the applied solution. It is disclosed that the concentration of the coating solution is from 1 to 20% by weight. However, the concentration of the coating solutions used in the working examples is 10% by weight. Decrease of the residual solvent in the formed bonding layer is not expectable at this concentration. Also, since the polyamide having a relatively low molecular weight is subjected to thermal polymerization, the initial strain becomes large.

Also, JP-A-5-225831 discloses a self-bonding insulated wire which is shape-retainable at high temperatures and which has a good fluidity and is easy to melt-bond to each other. In working examples thereof, a melt-bonding film composed mainly of a copolyamide having a melting point of 110° C. and a reduced specific viscosity of 1.02 to 1.30 is formed on a conductor through an interposed insulated film. A cresol solution of the copolyamide is used as a melt-adhesive coating for forming the melt-bonding film. The resin concentration of the coating is disclosed to be 200% by weight, but 200% appears to be clerical error. Since the resin concentration is unknown, it is not clear whether JP-A-5-225831 achieves the decrease of the residual solvent in the formed bonding layer. The bonding layer of self-bonding insulated wire according to JP-A-5-225831 has no sufficient strength, and also the initial strain appears to be large.

Further, it is conceivable that the amount of residual solvent may be decreased by elevating the oven temperature for baking the applied coating. However, in that case, thermal decomposition of a melt-adhesive resin is easy to occur and, therefore, the heat distortion resistance of the obtained deflecting yoke coil is lowered and the coil is easy to become inoperable. No proposal to solve the problem encountered when elevating the baking temperature has been made.

It is an object of the present invention to solve the problems as mentioned above on self-bonding insulated wires and self-bonding litz wires.

A further object of the present invention is to provide a self-bonding insulated wire which has excellent heat distortion resistance and adhesive strength and a decreased amount of a residual solvent and which can provide coils having a small initial strain and a small dimensional change with good workability and productivity.

A still further object of the present invention is to provide a self-bonding litz wire comprising the self-bonding insulated wire having such advantages.

These and other objects of the present invention will become apparent from the description hereinafter.

SUMMARY OF THE INVENTION

It has been found that the resin concentration of a coating used for forming the bonding layer of self-bonding insulated wires can be increased without deteriorating the coating workability by using a specific crystalline copolyamide as the melt-bonding component of the bonding layer.

Thus, in accordance with the present invention, there is provided a self-bonding insulated wire having a bonding layer on an insulated wire, wherein said bonding layer is formed by applying and baking a coating comprising a crystalline copolyamide having a melting point within the range of 105 to 150° C. and a relative viscosity of 1.4 to 1.6 measured at 25° C. with respect to a 0.5% by weight m-cresol solution thereof, and the relative viscosity of a 0.5% by weight solution of said formed bonding layer dissolved in m-cresol is from 1.4 to 1.6 at 25° C.

In the present invention, a coating containing a specific crystalline copolyamide is used for forming the melt-bonding layer of self-bonding insulated wires, whereby a higher resin concentration can be achieved as compared with conventional coatings for forming the melt-bonding layer without lowering the coating workability. Accordingly, the residual solvent in the self-bonding insulated wire can be remarkably decreased to diminish the problems on odor and working environment. Also, the productivity is improved. Moreover, the initial strain is small and the heat resistance is excellent.

It has also been found that the initial strain can be decreased by using the crystalline copolyamide in combination with a high-melting nylon, and that the thermal deterioration of every polyamide resins incorporated in the bonding layer can be prevented by incorporating an antioxidant into the bonding layer, whereby it is possible to provide deflecting yoke coils that the wire-wire adhesive strength is hard to lower during the use.

Thus, the present invention also provides a self-bonding insulated wire having a bonding layer on an insulated wire, said bonding layer comprising a crystalline copolyamide having a melting point within the range of 105 to 150° C. and a relative viscosity of 1.4 to 1.6 measured at 25° C. with respect to a 0.5% by weight m-cresol solution thereof, and at least one member selected from the group consisting of a high-melting nylon having a melting point within the range of 200 to 300° C. and an antioxidant.

From these self-bonding insulated wires of the present invention, self-bonding litz wires are prepared by stranding a plurality of the wires in a known manner.

DETAILED DESCRIPTION

Figure 1:
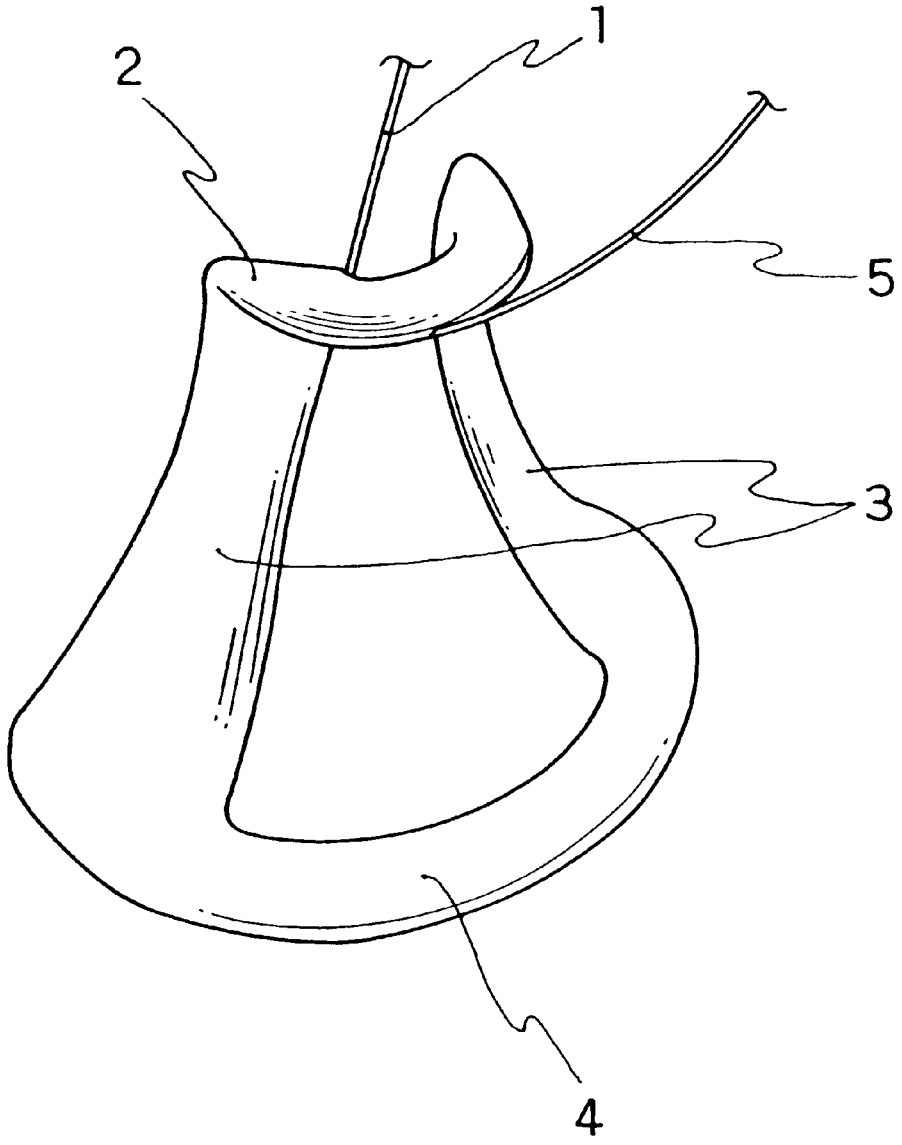
FIG. 1 is an illustrative view of a deflecting coil prepared using a self-bonding insulated wire or a self-bonding litz wire.

The self-bonding insulated wire of the present invention comprises an insulated wire and a bonding layer formed on an insulation layer of the insulated wire. The bonding layer contains a crystalline copolyamide as the main component. Since the crystalline copolyamide is used as the main component of the bonding layer, the resin concentration of the coating can be increased, so the problems in odor and working environment can be diminished. Also, when the bonding layer is formed so that the crystalline copolyamide has substantially the same relative viscosity before applying the coating and after forming the layer by baking, that is to say, when the relative viscosity as measured with respect to a solution prepared by dissolving the bonding layer formed on an insulated wire in m-cresol in a concentration of 0.5% by weight falls within the range of 1.4 to 1.6, bonding layers having a small initial strain and an excellent heat resistance are formed.

The crystalline copolyamide is preferably those having a crystallization energy of not less than 10 J/g measured by DSC, especially not less than 20 J/g, more especially not less than 30 J/g. If the crystallization energy is less than 10 J/g, there are tendencies that the initial strain of a coil molded from the wire becomes large, the adhesive force is low, and the heat distortion resistance is also lowered.

The term "copolyamide" as used herein means copolymers prepared by copolymerization of a mixture of monomers selected from raw materials of polyamides such as ϵ-caprolactam, ω-laurolactam, δ-valerolactam, dodecanoic diacid, adipic acid, sebacic acid, azelaic acid, hexamethylenediamine, cyclohexanediamine, isophoronediamine, aminocaproic acid, aminoundecanoic acid and aminododecanoic acid.

The crystalline copolyamide used in the present invention has a melting point within the range of 105 to 150° C., preferably 120 to 150° C., more preferably 130 to 150° C. The relative viscosity $\eta_r$ of a 0.5% by weight solution of the crystalline copolyamide in m-cresol measured at 25° C. falls within the range of 1.4 to 1.6, preferably 1.47 to 1.57.

A self-bonding insulated wire of this sort and a self-bonding litz wire made therefrom are required to have a heat resistance over 105° C. at present and would probably be required to have a heat resistance over 120° C. in future. For such a point of view, it is important that the crystalline copolyamide has a melting point of not lower than 105° C., preferably not lower than 120° C., more preferably not lower than 130° C. If the melting point of the crystalline copolyamide is higher than 150° C., the self-bonding insulated wire or litz wire must be handled under a high temperature condition exceeding 150° C. in the production of coils, so not only the insulation property is deteriorated owing to thermal degradation, but also the formability of the wire to deflecting yoke coil by melt-bonding is lowered and a failure such as loosing of wound wire is easy to occur.

If the relative viscosity $\eta_r$ is more than 1.6, the molecular weight of the copolyamide is too large, so the viscosity of coatings increases to result in marked lowering of coating and baking workability. In that case, the workability can be improved by decreasing the resin concentration, but the amount of the solvent increases and the solvent is apt to remain in the bonding layer. If the relative viscosity $\eta_r$ is less than 1.4, the wire-wire adhesive property and heat distortion resistance of coils are lowered, since the molecular weight of the copolyamide is small.

The crystalline copolyamides are high molecular weight compounds which constitute the main chain by repetition of acid amide bonds and include, for instance, ring-opening polymerization products of at least two lactams, polycondensation products of a combination of at least one dibasic acid and at least two diamines or a combination of at least two dibasic acids and at least one diamine, polycondensation products of at least two amino acids, and copolymerization products of other combinations of monomers selected from lactams, dibasic acids, diamines and amino acids, e.g., a combination of a lactam and an amino acid. The crystalline copolyamides may be used alone or in admixture thereof.

Examples of the lactam are, for instance, ϵ-caprolactam, ω-laurolactam, δ-valerolactam, and the like. Examples of the dibasic acid are, for instance, dodecanoic diacid, adipic acid, sebacic acid, azelaic acid, and the like. Examples of the diamine are, for instance, hexamethylenediamine, cyclohexanediamine, isophoronediamine, and the like. Examples of the amino acid are, for instance, aminocaproic acid, aminoundecanoic acid, aminododecanoic acid, and the like.

Copolyamides of 10 to 20% by weight of ϵ-caprolactam, 50 to 65% by weight of ω-laurolactam and 20 to 30% by weight of hexamethylenediamine dodecanoate are preferred as the crystalline copolyamide from the viewpoint of good balance of crystallinity, heat resistance and initial strain. These copolyamides have a melting point of 105 to 150° C. within the above range of the monomer proportions. The relative viscosity thereof can be controlled by changing the proportions of the monomers.

The crystalline copolyamide can be used in combination with a high-melting nylon having a melting point of 200 to 300° C. and/or an antioxidant.

The high-melting nylon serves to prevent coils from producing an initial strain at the time of molding the coils from a self-bonding insulated wire by coiling the wire, fusing together and press-forming the wound wire. The initial strain is produced by torsion of a coil resulting from deformation in shape which occurs, when cooling the press-formed coil to room temperature, to enhance the size of the coil larger than the size of a coiling mold.

Polyamides having a melting point of 200 to 300° C., preferably 210 to 300° C., are used in the present invention as the high-melting nylon. Any high-melting nylons having a melting point within the above range can improve the strength of the bonding layer and can prevent occurrence of a strain which generates at the time of coil molding, namely occurrence of the initial strain. If the melting point is less than 200° C., these effects are not sufficiently obtained. If the melting point is more than 300° C., the workability in the preparation of coatings is deteriorated since the solubility of the nylon in organic solvents is lowered.

The high-melting nylon can be incorporated into coatings which provide bonding layers the relative viscosity of which measured with respect to a 0.5% by weight m-cresol solution prepared by dissolving the bonding layer formed on an insulated wire in m-cresol does not fall within the range of 1.4 to 1.6, and whereby bonding layers having a small initial strain and an excellent heat resistance can be formed. However, it is preferable to incorporate the high-melting nylon into coatings which provide bonding layers having a relative viscosity of 1.4 to 1.6 measured in the same manner. In that case, the relative viscosity measured in the same manner of the bonding layers formed from the coatings incorporated with the high-melting nylon usually falls within the range of 1.4 to 1.6.

Examples of the high-melting nylon are, for instance, nylon 66, nylon 46, nylon 6 and other polyamide homopolymers. The high-melting nylons used in the present invention are not limited to these homopolymers, and copolyamides can also be used so long as they have a melting point within the range of 200 to 300° C. Of these, nylon 66 and nylon 46 are preferred since the effect of decreasing the initial strain is large and the influence on lowering of adhesive property is a little.

In order to obtain marked effects of the high-melting nylon without impairing the performances of the crystalline copolyamide, it is preferable to use the high-melting nylon in an amount of 2 to 10 parts by weight, especially 4 to 8 parts by weight, per 100 parts by weight of the crystalline copolyamide. If the amount of the high-melting nylon is more than 10 parts by weight, the high-melting nylon tends to greatly impair the adhesive property of the bonding layer. Thus, it is particularly preferable to use the high-melting nylon in an amount of not more than 8 parts by weight. If the amount is less than 2 parts by weight, it is difficult to obtain a sufficient effect of initial strain prevention.

The antioxidant is used for the purpose of preventing thermal degradation of polyamide resins included in the bonding layer, namely the crystalline copolyamide or a combination of the crystalline copolyamide and the high-melting nylon, to thereby prevent lowering of the wire-wire adhesive force of deflecting yoke coils during their use.

As the antioxidant can be used known antioxidants, e.g., phenolic antioxidants, sulfur-based antioxidants, phosphorus-based antioxidants and amine-based antioxidants. Of these, phenolic antioxidants are preferred from the viewpoint of large antioxidizing effect.

Examples of the phenolic antioxidant are, for instance, hydroquinone, hydroquinone monomethyl ether, 2,5-di-t-butylhydroquinone, 2,5-di-t-amylhydroquinone, t-butylcatechol, styrenated phenol, 2-t-butyl-4-methylphenol, 2,6-di-t-butylphenol, polybutylated bisphenol A, bisphenol A, 2,4,5-trihydroxybutyrophenone, 2,6-di-t-butyl-4-methylphenol, 4,6-di-t-butyl-2-methylphenol, butylhydroxyanisole, 2,2'-methylenebis(4-methyl-6-t-butylphenol), 4,4'-methylenebis(2,6-di-t-butylphenol), tris (2-methyl-4-hydroxy-5-t-butylphenol)butane, 1,3,5-triethyl-2,4,6-tris83,5-di-t-butyl-4-hydroxy-benzyl)benzene, tetrakis [methylene-(3',5'-di-t-butyl-4-hydroxyhydrocin-namate)] methane, 1,3,5-tris(4-t-butyl-3-hydroxy-2,6-dimethylbenzyl) -isocyanurate, 1,3,5-tris(3,5-di-t-butyl-4-hydroxybenzyl)isocyanurate, and antioxidants commercially available from Ciba Specialty Chemicals K.K. Japan, e.g., IRGANOX 245, IRGANOX 259, IRGANOX 565, IRGANOX 1010, IRGANOX 1035, IRGANOX 1076, IRGANOX 1081, IRGANOX 1098 (N,N'-hexane-1,6-diylbis[3-(3,5-di-t-butyl-4-hydroxyphenyl) propionamide]), IRGANOX 1222, IRGANOX 1330, IRGANOX 1425WL and IRGANOX B1171. Of these, IRGANOX 1098 is preferable from the viewpoint of good compatibility with the polyamide resins used as a self-bonding resin (namely crystalline copolyamide or a combination of crystalline copolyamide and high-melting nylon).

The amount of the antioxidant is from 0.3 to 5.0 parts by weight, preferably 0.4 to 3.2 parts by weight, more preferably 0.4 to 1.5 parts by weight, per 100 parts by weight of the total of polyamide resins to be used in the bonding layer, namely the total of the crystalline copolyamide and the high-melting nylon. If the amount of the antioxidant is less than 0.3 part by weight, the thermal degradation resistance of the polyamide resins is hard to be improved. If the amount is more than 5.0 parts by weight, not only the cost increases, but also the coating workability tends to lower since the antioxidant becomes hard to be dissolved in the solvent of a melt-adhesive coating.

The self-bonding insulated wires of the present invention are prepared by dissolving a coating film component comprising a crystalline copolyamide or a coating film component comprising the crystalline copolyamide and at least one of a high-melting nylon and an antioxidant in an organic solvent to give a melt-adhesive coating, applying the coating onto an insulated wire and baking it.

Any good solvents for the coating film component can be used as the organic solvent for preparing the coating. Examples of the organic solvent are, for instance, cresol, phenol, xylenol, N-methylpyrolidone, and an alcohol such as methanol, ethanol, 2-ethylhexanol or benzyl alcohol. Also, poor solvents for the polyamide resins, e.g., various aromatic naphtha solvents, xylene and toluene, can be used together with the good solvents, as occasion demands. The solvents may be used alone or in admixture thereof. A mixed solvent composed of a cresol and an aromatic naphtha in a ratio of 40:60 to 90:10 by weight is preferable from the viewpoints of solubility of the crystalline copolyamide and cost.

The concentration of the coating film component in the melt-adhesive coating varies depending on the size of the insulated wire used and the like, but is preferably from about 15 to about 25% by weight, especially about 16 to about 25% by weight, more especially about 17 to about 22% by weight. If the concentration is less than 15% by weight, not only the coating-baking operation must be repeated any number of times to form a bonding layer having a desired thickness, resulting in lowering of the productivity, but also the amount of residual solvent in the bonding layer tends to increase. If the concentration is more than 25% by weight, the viscosity of the coating is high, so the coating-baking workability is lowered and also there is a case that polyamide resins are not homogeneously dissolved in the solvent.

The melt-adhesive coating may be incorporated with a suitable lubricant within the range not impairing the effects of the present invention in order to impart a lubricity to the self-bonding insulated wire so as to be able to use as a self-lubricating insulated wire. Examples of the lubricant are, for instance, a polyolefin such as low density polyethylene, medium density polyethylene, high density polyethylene, polypropylene, polybutylene, polymethylpentene or ethylene-propylene copolymer, a fluorine-containing resin such as polytetrafluoroethylene, tetrafluoroethylene-hexafluoropropylene copolymer or polyvinylidene fluoride, a wax such as solid paraffin, microcrystalline wax, carnauba wax, bees wax, montan wax, ozokerite, ceresin, haze wax, candelilla wax, shellac wax, spermaceti wax or enolin.

The insulated wires used in the self-bonding insulated wire of the present invention comprises a conductor such as copper, copper alloy, aluminum or aluminum alloy and an insulating layer provided on the conductor, e.g., layer of polyesterimide, polyurethane, polyester, polyesterimide urethane, polyamideimide, polyamideimide urethane, polyimide, polyesteramide or polyesteramideimide. Any insulated wires conventionally used can be used in the present invention.

The method for applying the melt-adhesive coating onto the insulated wire is not particularly restricted. The coating can be applied by a conventional method such as die squeezing method or felt squeezing method.

The number of coating-baking operations to form the melt-bonding layer on an insulated wire varies depending on the thickness of the bonding layer to be formed, but is generally 2 to 5 times, preferably 3 to 4 times. If the number of coating-baking operations is one time, the variation in thickness of the bonding layer formed is large. If the coating is recoated 6 times or more, the productivity lowers and the cost increases.

The thickness of the bonding layer of the self-bonding insulated wire of the present invention varies depending on the kind and size of the self-bonding insulated wire, but is from 5 to 20 $\mu$m, especially from 5 to 15 $\mu$m, and is generally about 10 $\mu$m. If the thickness is less than 5 $\mu$m, a proper bonding force is not obtained when producing deflecting coils. If the thickness is more than 20 $\mu$m, the cost increases.

A suitable lubricant may be coated on the bonding layer of the self-bonding insulated wires, so long as the effects of the present invention are not impaired, for the purpose of enabling to use as a self-lubricating insulated wires by imparting a good lubricity to the self-bonding insulated wires of the present invention.

Self-bonding litz wires can be prepared from the self-bonding insulated wires of the present invention by stranding a plurality of the wires (e.g., 5 to 40 strands) according to a known method.

As stated before, in recent years, in order to reduce heat generation of coil per se by eddy-current loss and skin effect loss in deflecting yoke coil resulting from high resolution and high frequency application to CRT display, use of self-bonding litz wires wherein self-bonding insulated wires with small conductor size (0.10 to 0.20 mm) are stranded is becoming popular. In case of producing self-bonding insulated wires having a small conductor size, in other words, in case of applying a melt-adhesive coating onto an insulated wire of very thin conductor and baking it, drawing of the conductor and a failure such as breaking of wire are easy to occur. Therefore, it is preferable to use a melt-adhesive coating having a low viscosity. Also, since self-bonding insulated wires having a small conductor size have a larger film volume occupation percentage per unit length than self-bonding insulated wires having a large conductor size, the amount of residual solvent tends to increase. Therefore, the self-bonding insulated wires of the present invention are very suitable for the production of self-bonding litz wires.

Conventional melt-adhesive coatings used for preparing self-bonding insulated wires contain usually 85% by weight or more of a solvent, since the coatings are required to adjust a proper viscosity so as not to cause problems such as drawing of conductor at the time of the preparation of the wires. Unlike conventional coatings, according to the present invention, a high resin concentration can be achieved without increasing the viscosity of the coatings as a result of using the crystalline copolyamide.

Also, in case of baking the coated insulated wires according to the present invention under the same conditions as those for conventional coatings, reduction of the residual solvent content far beyond expectations is achieved. For example, in case of preparing the self-bonding insulated wires of the present invention under such a baking condition that a conventional coating provides a self-bonding insulated wire having a residual solvent content of about 1.0% by weight based on the bonding layer, the residual solvent content can be reduced to at most 0.8% by weight, e.g., about 0.2% by weight.

In Table 1 is shown a comparison in residual solvent content between the production of self-bonding insulated wire using the melt-adhesive coating of the present invention and that using a conventional coating.

TABLE 1

| | Prior art | Invention |
|---|---|---|
| Melt-adhesive coating | | |
| Viscosity of coating (dPa · s) | 20 | 20 |
| Resin concentration (wt. %) | 15 | 19 |
| Solvent concentration (wt. %) | 85 | 81 |
| Self-bonding insulated wire | | |
| Residual solvent content (wt. %) | 1.0 | 0.2 |

As shown in Table 1, the viscosity of a conventional coating and a coating of the present invention was adjusted to 20 dPa.s so as to permit proper production of self-bonding insulated wires. The concentration of the coating film component in the thus prepared coating of the present invention is 19% by weight, whereas the concentration of the coating film component in the thus prepared conventional coating is 15% by weight. Accordingly, the amount of the solvent can be decreased by 4% by weight as compared with the conventional coating, and effective utilization of resources is possible according to the present invention. The coating-baking operation was conducted under the same conditions to produce self-bonding insulated wires. The residual solvent content in the self-bonding insulated wire of the present invention is remarkably reduced in a higher degree of reduction than the degree of reduction in the amount of solvent in the coating (from 85% by weight to 81% by weight). Thus, problems in odor and environment can be diminished.

The present invention is more specifically described and explained by means of the following Examples and Comparative Examples, in which all % and parts are by weight unless otherwise noted. It is to be understood that the present invention is not limited to these Examples.

In the Examples and Comparative Examples, evaluation was made according to the following methods.

Melting Point and Crystallization Energy

A DSC curve was measured using about 10 mg of a crystalline copolyamide under the conditions that the temperature was elevated from 0° C. to 300° C. at a rate of 10° C./minute and dropped from 300° C. to 0° C. at a rate of 10° C./minute. The melting point was measured from the peak on the obtained DSC curve, and the crystallization energy was calculated from the area of the peak.

Relative Viscosity of Crystalline Copolyamide and Relative Viscosity of a Bonding Layer of a Self-Bonding Insulated Wire About 0.25 g of a crystalline copolyamide was dissolved in m-cresol to give a 0.5% solution, and the relative viscosity of the obtained solution was measured using a Ubbelohde's viscometer at 25° C.

The relative viscosity of the bonding layer of a self-bonding insulated wire was measured by immersing the self-bonding insulated wire in m-cresol for 1 hour to dissolve the bonding layer, drying the obtained m-cresol solution at 120° C. for 3 hours to obtain the film component of the bonding layer, dissolving the obtained film component in m-cresol to give a 0.5% solution, and measuring the relative viscosity of the obtained solution at 25° C. using a Ubbelohde's viscometer.

Concentration of Film Component in a Coating

After heating 1.5 g of a coating for forming the melt-bonding layer at 170° C. for 2 hours, the weight of non-volatile matter was measured and the resin concentration (%) was calculated according to the equation: (weight of non-volatile matter)×100/(weight of coating).

Viscosity of Coating

The viscosity of a melt-bonding coating was measured at 30° C. by a Brookfield viscometer.

Wire Production Workability

In the production of a self-bonding insulated wire by application of a melt-bonding coating onto an insulated wire followed by baking, the workability was evaluated "bad" when the diameter of a conductor decreased by at least 3 μm as compared with the diameter of the conductor prior to the coating and baking operation or when the wire was broken and the production was substantially impossible.

Residual Solvent Content

The content of residual solvent in a self-bonding insulated wire was measured by gas chromatography, and the residual solvent content was shown by the percentage of the weight of the residual solvent based on the weight of the bonding layer of the self-bonding insulated wire.

Size of Coil (Initial Strain)

Figure 2A:
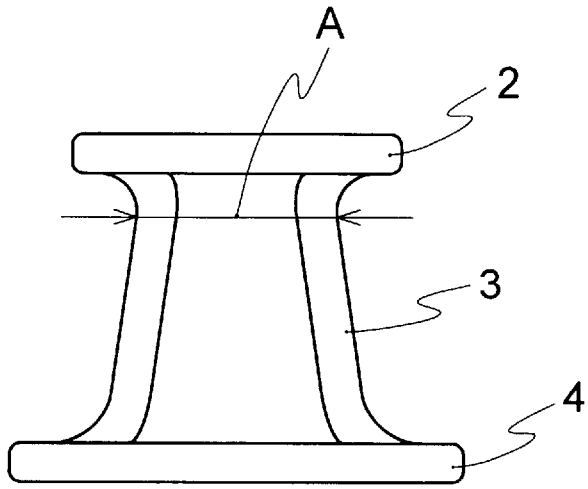
FIGS. 2(*a*) and 2(*b*) are views illustrating locations at which the dimensions of a prepared deflecting coil are measured.
Figure 2B:
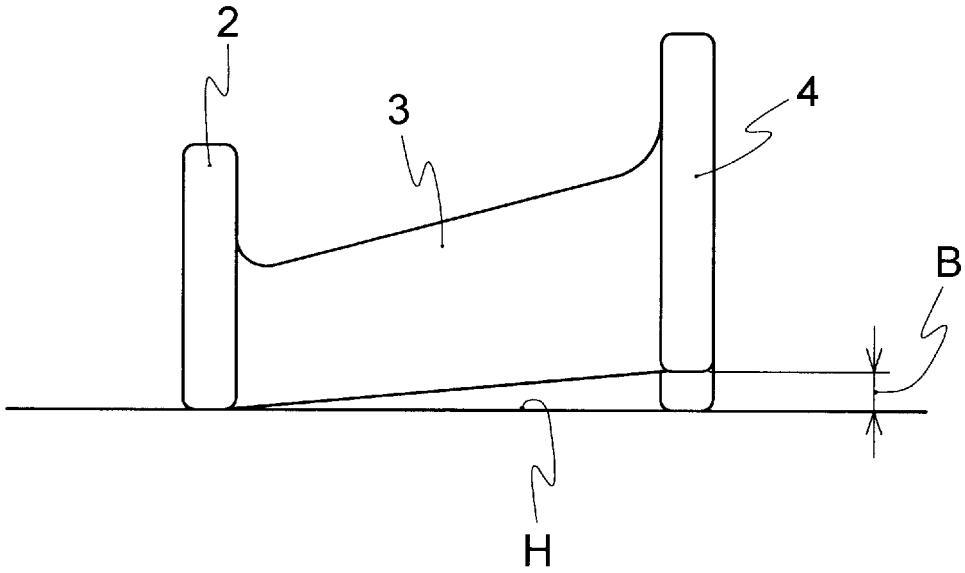

With respect to locations for measurement of size of a coil shown in FIGS. 2(*a*) and 2(*b*), the neck diameter A was measured by calipers and the amount of torsion B was measured by a clearance gage.

Amount of Change in Neck Diameter after Heat Resistance Test (Heat Distortion Resistance)

An obtained deflecting coil was heated at an oven kept at 120° C. or 130° C. for 2 hours, allowed to stand to cool to room temperature and the diameter of the neck of the coil was measured. The amount of change in neck diameter between before and after the heating is shown.

Adhesive Strength

Figure 3:
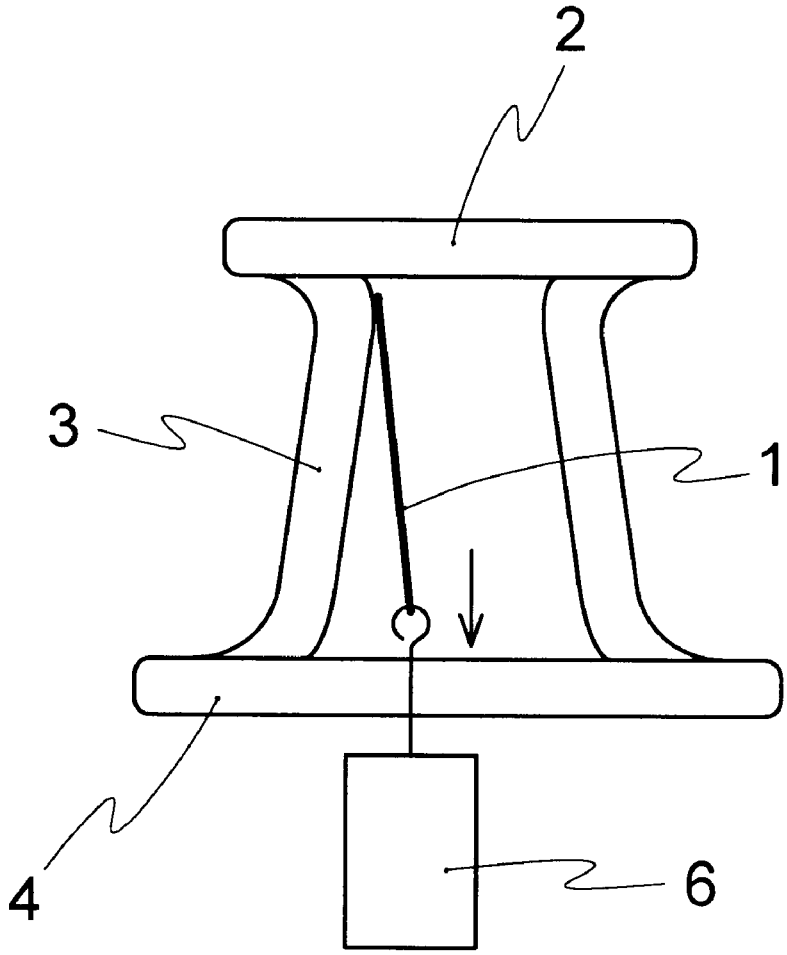
FIG. 3 is a view for explaining a method for measuring the adhesive strength of a prepared deflecting coil.

An obtained deflecting coil was allowed to stand at room temperature for 24 hours and then heated at 115° C. The adhesive strength of the coil was evaluated by measuring the melt-bonding force of one turn of an inner portion of the coil with a tension gage prior to the heating, after heating for 5 days and after heating for 20 days as shown in FIG. 3 wherein numeral 1 is a winding start end of a wire, numeral 2 is an upper flange portion, numeral 3 is a wound wire portion, numeral 4 is a lower flange portion and numeral 6 is a tension gage.

Thickness of Bonding Layer

The outer diameters of an insulated wire and a self-bonding insulated wire prepared therefrom were measured by a micrometer with the smallest scale division of 1/1,000 mm. The thickness was calculated by the equation: (outer diameter of self-bonding insulated wire —outer diameter of insulated wire)×½.

EXAMPLE 1

A crystalline copolyamide A of ε-caprolactam, ω-laurolactam and hexamethylenediamine dodecanoate having a melting point of 130° C., a relative viscosity of 1.52 (measured at 25° C. with respect to a 0.5% m-cresol solution of the copolyamide) and a crystallization energy of 46.9 J/g was dissolved in a mixed solvent of cresol and an aromatic (C9) naphtha in a ratio of 70:30 by weight to give a melt-bonding coating having a film component concentration (solid concentration) of 19%. The obtained coating had a viscosity of 20 dPa.s at 30° C.

The obtained coating was applied onto a polyesterimide-insulated wire (outer diameter of insulated wire: 0.19 mm, outer diameter of conductor: 0.15 mm) by a die squeezing method and was then baked in a baking oven kept at 300° C. (oven length: 3.0 m) by sending the wire at a rate of 60 m/minute. The application-baking operation was repeated 3 times to give a self-bonding insulated wire having a bonding layer of 10 μm in thickness.

Ten strands of the obtained self-bonding insulated wire were stranded to give a self-bonding litz wire. From the litz wire, a deflecting yoke coil shown in FIG. 1 was prepared by subjecting the litz wire to winding, melt-bonding and press-forming by a wire winding machine under the conditions of 55 turns×two strands winding, current for melt-bonding 55 A, bonding time (time of passing the current) 1.5 seconds, cold pressing time 15 seconds and mold temperature 40° C. In FIG. 1, numeral 1 is the winding start end of the wire, numeral 2 is an upper flange portion of the coil, numeral 3 is a wound wire portion of the coil, numeral 4 is a lower flange portion of the coil and numeral 5 is a winding finish end of the wire.

With respect to the obtained deflecting yoke coil, the dimensions shown in FIGS. 2(*a*) and 2(*b*), namely the neck diameter A (dimension at the narrowest portion) and the amount of torsion B (distance from the horizontal plane H to the lower end of the lower flange portion 4 lifted out of the horizontal plane H of the coil laid on its side so as to press the upper flange portion 2 and the wound portion 3 located on one side to the horizontal plane H), were measured. Also, the adhesive force was measured as shown in FIG. 3.

The results are shown in Table 2.

EXAMPLE 2

The procedure of Example 1 was repeated except that a crystalline copolyamide B of ε-caprolactam, ω-laurolactam and hexamethylenediamine dodecanoate having a melting point of 130° C., a relative viscosity of 1.42 and a crystallization energy of 44.8 J/g was used instead of the crystalline copolyamide A.

The results are shown in Table 2.

EXAMPLE 3

The procedure of Example 1 was repeated except that a crystalline copolyamide C of ε-caprolactam, ω-laurolactam and hexamethylenediamine dodecanoate having a melting point of 130° C., a relative viscosity of 1.47 and a crystallization energy of 47.7 J/g was used instead of the crystalline copolyamide A.

The results are shown in Table 2.

EXAMPLE 4

The procedure of Example 1 was repeated except that a crystalline copolyamide D of ε-caprolactam, ω-laurolactam and hexamethylenediamine dodecanoate having a melting point of 130° C., a relative viscosity of 1.57 and a crystallization energy of 50.6 J/g was used instead of the crystalline copolyamide A.

The results are shown in Table 2.

COMPARATIVE EXAMPLE 1

The procedure of Example 1 was repeated except that a crystalline copolyamide X of ε-caprolactam, ω-laurolactam and hexamethylenediamine dodecanoate having a melting point of 130° C., a relative viscosity of 1.70 and a crystallization energy of 41.4 J/g was used instead of the crystalline copolyamide A.

The wire breaking occurred frequently due to high viscosity of a melt-bonding coating, so the production of self-bonding insulated wire was difficult. In the obtained self-bonding insulated wire, the conductor had a diameter drawn by about 3 μm.

The results are shown in Table 2.

COMPARATIVE EXAMPLE 2

The procedure of Example 1 was repeated except that a crystalline copolyamide X of ϵ-caprolactam, ω-laurolactam and hexamethylenediamine dodecanoate having a melting point of 130° C., a relative viscosity of 1.70 and a crystallization energy of 41.4 J/g was used instead of the crystalline copolyamide A, and the coating was prepared to have a solid concentration of 14%.

The results are shown in Table 2.

COMPARATIVE EXAMPLE 3

The procedure of Example 1 was repeated except that a crystalline copolyamide Y of ϵ-caprolactam, ω-laurolactam and hexamethylenediamine dodecanoate having a melting point of 130° C., a relative viscosity of 1.35 and a crystallization energy of 41.0 J/g was used instead of the crystalline copolyamide A.

The results are shown in Table 2.

COMPARATIVE EXAMPLE 4

The procedure of Example 1 was repeated except that a copolyamide Z of ϵ-caprolactam, ω-laurolactam and hexamethylenediamine dodecanoate having a melting point of 120° C., a relative viscosity of 1.48 and a crystallization energy of 0 J/g was used instead of the crystalline copolyamide A.

The results are shown in Table 2.

TABLE 2

| | Ex. 1 | Ex. 2 | Ex. 3 | Ex. 4 | Com. Ex. 1 | Com. Ex. 2 | Com. Ex. 3 | Com. Ex. 4 |
|---|---|---|---|---|---|---|---|---|
| Crystalline copolyamide | | | | | | | | |
| Kind | A | B | C | D | X | X | Y | Z |
| Melting point (° C.) | 130 | 130 | 130 | 130 | 130 | 130 | 130 | 120 |
| Relative viscosity | 1.52 | 1.42 | 1.47 | 1.57 | 1.70 | 1.70 | 1.35 | 1.48 |
| Crystallization energy (J/g) | 46.9 | 44.8 | 47.7 | 50.6 | 41.4 | 41.4 | 41.0 | 0 |
| Coating for forming bonding layer | | | | | | | | |
| Solid concentration (%) | 19 | 19 | 19 | 19 | 19 | 14 | 19 | 19 |
| Viscosity (dPa · s) | 20 | 18.5 | 21.0 | 20.5 | 48.0 | 19.5 | 18.5 | 19.0 |
| Wire production workability | good | good | good | good | bad | good | good | good |
| Relative viscosity of bonding layer of self-bonding insulated wire | 1.50 | 1.40 | 1.44 | 1.56 | 1.68 | 1.67 | 1.33 | 1.46 |
| Residual solvent content (%) | 0.1 | 0.1 | 0.2 | 0.1 | 0.2 | 1.5 | 0.2 | 0.2 |
| Dimensions of coil (initial strain) | | | | | | | | |
| Diameter of neck (mm) | 40.7 | 40.8 | 40.7 | 40.7 | 40.7 | 40.7 | 41.0 | 41.6 |
| Amount of torsion (mm) | 0.3 | 0.4 | 0.3 | 0.3 | 0.3 | 0.3 | 0.6 | 1.3 |
| Amount of change in neck diameter after heat treatment (mm) | | | | | | | | |
| at 120° C. | 0.0 | 0.0 | 0.0 | 0.0 | 0.0 | 0.0 | 0.5 | 0.6 |
| at 130° C. | 0.1 | 0.2 | 0.1 | 0.1 | 0.1 | 0.1 | 1.4 | 3.1 |
| Adhesive strength before heating (N) | 7.4 | 7.2 | 7.2 | 7.0 | 7.3 | 7.3 | 4.3 | 4.6 |

(Note)
Thickness of the bonding layers are all 10 μm.

In Comparative Example 1, a crystalline copolyamide having a relative viscosity of 1.7 is used and, therefore, production of self-bonding insulated wires at a solid concentration of 19% is difficult since the viscosity of the melt-bonding coating is too high.

In Comparative Example 2, a melt-bonding coating containing the crystalline copolyamide having a relative viscosity of 1.7 is prepared to have a solid concentration of 14% and, therefore, the viscosity of the coating falls within a coatable range and production of self-bonding insulated wires is possible. However, since the amount of a solvent is large, the produced self-bonding insulated wires have a large residual solvent content.

In Comparative Example 3, a crystalline copolyamide having a relative viscosity of 1.35 is used and, therefore, the wire-wire adhesive force of coils is low and the amount of change in neck diameter after heat treatment is large.

In Comparative Example 4, a non-crystalline copolyamide is used. The neck diameter and torsion (initial strain) of coils are large, the adhesive force is low, and the amount of change in neck diameter after heat treatment is large.

In contrast, the results shown in Table 2 demonstrate that the melt-bonding coatings according to the present invention can be prepared to have a coatable viscosity even if the solid concentration is high, that the obtained self-bonding insulated wires have a low residual solvent content and accordingly problems in odor and environment are diminished, and that deflecting coils produced from the self-bonding insulated wires or self-bonding litz wires have a low initial strain, a high wire-wire adhesive strength and a good heat distortion resistance.

EXAMPLE 5

A film component composed of the crystalline copolyamide A having a melting point of 130° C., a relative viscosity of 1.52 and a crystallization energy of 46.9 J/g and, per 100 parts of the copolyamide A, 3 parts of nylon 66 having a melting point of 260° C. as a high-melting nylon and 0.5 part of IRGANOX 1098 antioxidant was dissolved in a mixed solvent of cresol and an aromatic (C9) naphtha in a ratio of 70:30 by weight to give a melt-bonding coating having a film component concentration (solid concentration) of 19%. The obtained coating had a viscosity of 20 dPa.s at 30° C.

The obtained coating was applied onto a polyesterimide-insulated wire (outer diameter of insulated wire: 0.19 mm, outer diameter of conductor: 0.15 mm) by a die squeezing method and was then baked in a baking oven kept at 300° C. (oven length: 3.0 m) by sending the wire at a rate of 60 m/minute. The application-baking operation was repeated 3 times to give a self-bonding insulated wire having a bonding layer of 10 $\mu$m in thickness.

Ten strands of the obtained self-bonding insulated wire were stranded to give a self-bonding litz wire. From the litz wire, a deflecting yoke coil shown in FIG. 1 was prepared by subjecting the litz wire to winding, melt-bonding and press-forming by a wire winding machine under the conditions of 55 turns×two strands winding, current for melt-bonding 55 A, bonding time (time of passing the current) 1.5 seconds, cold pressing time 15 seconds and mold temperature 40° C.

With respect to the obtained deflecting yoke coil, the dimensions shown in FIGS. 2(*a*) and 2(*b*) were measured. Also, the adhesive force was measured as shown in FIG. 3.

The results are shown in Table 3.

EXAMPLE 6

The procedure of Example 5 was repeated except that the crystalline copolyamide B having a melting point of 130° C., a relative viscosity of 1.42 and a crystallization energy of 44.8 J/g was used instead of the crystalline copolyamide A.

The results are shown in Table 3.

EXAMPLE 7

The procedure of Example 5 was repeated except that the crystalline copolyamide C having a melting point of 130° C., a relative viscosity of 1.47 and a crystallization energy of 47.7 J/g was used instead of the crystalline copolyamide A.

The results are shown in Table 3.

EXAMPLE 8

The procedure of Example 5 was repeated except that the crystalline copolyamide D having a melting point of 130° C., a relative viscosity of 1.57 and a crystallization energy of 50.6 J/g was used instead of the crystalline copolyamide A.

The results are shown in Table 3.

EXAMPLE 9

The procedure of Example 5 was repeated except that a crystalline copolyamide E of ϵ-caprolactam, ω-laurolactam and hexamethylenediamine dodecanoate having a melting point of 130° C., a relative viscosity of 1.50 and a crystallization energy of 15.3 J/g was used instead of the crystalline copolyamide A.

The results are shown in Table 3.

EXAMPLE 10

The procedure of Example 5 was repeated except that the amount of nylon 66 was changed to 8.0 parts.

The results are shown in Table 3.

EXAMPLE 11

The procedure of Example 5 was repeated except that nylon 46 having a melting point of 290° C. was used instead of nylon 66.

The results are shown in Table 3.

EXAMPLE 12

The procedure of Example 5 was repeated except that the amount of the IRGANOX 1098 antioxidant was changed to 3 parts.

The results are shown in Table 3.

EXAMPLE 13

The procedure of Example 5 was repeated except that the high-melting nylon was not used.

The results are shown in Table 3.

EXAMPLE 14

The procedure of Example 5 was repeated except that the antioxidant was not used.

The results are shown in Table 3.

COMPARATIVE EXAMPLE 5

The procedure of Example 5 was repeated except that the crystalline copolyamide X having a melting point of 130° C., a relative viscosity of 1.70 and a crystallization energy of 41.4 J/g was used instead of the crystalline copolyamide A.

The wire breaking occurred frequently due to high viscosity of a melt-bonding coating, so the production of self-bonding insulated wire was difficult. In the obtained self-bonding insulated wire, the conductor had a diameter drawn by about 3 $\mu$m.

The results are shown in Table 3.

COMPARATIVE EXAMPLE 6

The procedure of Example 5 was repeated except that the crystalline copolyamide X having a melting point of 130° C., a relative viscosity of 1.70 and a crystallization energy of 41.4 J/g was used instead of the crystalline copolyamide A, and the coating was prepared to have a solid concentration of 14%.

The results are shown in Table 3.

COMPARATIVE EXAMPLE 7

The procedure of Example 5 was repeated except that the crystalline copolyamide Y having a melting point of 130° C., a relative viscosity of 1.35 and a crystallization energy of 41.0 J/g was used instead of the crystalline copolyamide A.

The results are shown in Table 3.

COMPARATIVE EXAMPLE 8

The procedure of Example 5 was repeated except that the copolyamide Z having a melting point of 120° C., a relative viscosity of 1.48 and a crystallization energy of 0 J/g was used instead of the crystalline copolyamide A.

The results are shown in Table 3.

TABLE 3

| | Ex. 5 | Ex. 6 | Ex. 7 | Ex. 8 | Ex. 9 | Ex. 10 | Ex. 11 | Ex. 12 |
|---|---|---|---|---|---|---|---|---|
| Crystalline copolyamide | | | | | | | | |
| Kind | A | B | C | D | E | A | A | A |
| Melting point (° C.) | 130 | 130 | 130 | 130 | 130 | 130 | 130 | 130 |
| Relative viscosity | 1.52 | 1.42 | 1.47 | 1.57 | 1.50 | 1.52 | 1.52 | 1.52 |
| Crystallization energy (J/g) | 46.9 | 44.8 | 47.7 | 50.6 | 15.3 | 46.9 | 46.9 | 46.9 |
| High-melting nylon | | | | | | | | |
| Kind | nylon66 | nylon66 | nylon66 | nylon66 | nylon66 | nylon66 | nylon46 | nylon66 |
| Amount (part) | 3 | 3 | 3 | 3 | 3 | 8 | 3 | 3 |
| Antioxidant: amount (part) | 0.5 | 0.5 | 0.5 | 0.5 | 0.5 | 0.5 | 0.5 | 3 |
| Coating for forming bonding layer | | | | | | | | |
| Solid concentration (%) | 19 | 19 | 19 | 19 | 19 | 19 | 19 | 19 |
| Viscosity (dPa · s) | 20.0 | 18.5 | 20.0 | 20.5 | 19.5 | 21.5 | 20.0 | 20.0 |
| Wire production workability | good | good | good | good | good | good | good | good |
| Relative viscosity of bonding layer of self-bonding insulated wire | 1.51 | 1.42 | 1.47 | 1.57 | 1.50 | 1.51 | 1.52 | 1.51 |
| Residual solvent content (%) | 0.1 | 0.1 | 0.2 | 0.1 | 0.2 | 0.1 | 0.1 | 0.1 |
| Dimensions of coil (initial strain) | | | | | | | | |
| Diameter of neck (mm) | 40.5 | 40.5 | 40.4 | 40.4 | 40.6 | 40.5 | 40.5 | 40.5 |
| Amount of torsion (mm) | 0.1 | 0.2 | 0.1 | 0.1 | 0.3 | 0.1 | 0.1 | 0.1 |
| Amount of change in neck diameter after heat treatment (mm) | | | | | | | | |
| at 120° C. | 0.0 | 0.0 | 0.0 | 0.0 | 0.1 | 0.0 | 0.1 | 0.0 |
| at 130° C. | 0.1 | 0.2 | 0.1 | 0.1 | 0.2 | 0.2 | 0.2 | 0.1 |
| Adhesive strength (N) | | | | | | | | |
| Before heating | 7.3 | 6.9 | 7.2 | 7.0 | 6.9 | 6.8 | 7.3 | 7.4 |
| After 5 days | 7.5 | 7.1 | 7.3 | 7.2 | 7.0 | 7.0 | 7.4 | 7.3 |
| After 20 days | 7.3 | 7.0 | 7.1 | 7.0 | 6.8 | 6.8 | 7.2 | 7.3 |

| | Ex. 13 | Ex. 14 | Com. Ex. 5 | Com. Ex. 6 | Com. Ex. 7 | Com. Ex. 8 |
|---|---|---|---|---|---|---|
| Crystalline copolyamide | | | | | | |
| Kind | A | A | X | X | Y | Z |
| Melting point (° C.) | 130 | 130 | 130 | 130 | 130 | 120 |
| Relative viscosity | 1.52 | 1.52 | 1.70 | 1.70 | 1.35 | 1.48 |
| Crystallization energy (J/g) | 46.9 | 46.9 | 41.4 | 41.4 | 41.0 | 0 |
| High-melting nylon | | | | | | |
| Kind | — | nylon66 | nylon66 | nylon66 | nylon66 | nylon66 |
| Amount (part) | — | 3 | 3 | 3 | 3 | 3 |
| Antioxidant: amount (part) | 0.5 | 0 | 0.5 | 0.5 | 0.5 | 0.5 |
| Coating for forming bonding layer | | | | | | |
| Solid concentration (%) | 19.0 | 19.0 | 19.0 | 14.0 | 19.0 | 19.0 |
| Viscosity (dPa · s) | 20.0 | 20.0 | 49.0 | 19.5 | 18.5 | 19.0 |
| Wire production workability | good | good | bad | good | good | good |
| Relative viscosity of bonding layer of self-bonding insulated wire | 1.52 | 1.52 | 1.70 | 1.69 | 1.35 | 1.48 |
| Residual solvent content (%) | 0.1 | 0.2 | 0.2 | 1.5 | 0.2 | 0.2 |
| Dimensions of coil (initial strain) | | | | | | |
| Diameterof neck (mm) | 40.7 | 40.4 | 40.5 | 40.5 | 41.1 | 41.0 |
| Amount of torsion (mm) | 0.4 | 0.2 | 0.1 | 0.1 | 0.9 | 0.9 |
| Amount of change in neck diameter after heat treatment (mm) | | | | | | |
| at 120° C. | 0.1 | 0.1 | 0.0 | 0.1 | 0.6 | 0.6 |
| at 130° C. | 0.2 | 0.1 | 0.1 | 0.2 | 1.5 | 3.0 |
| Adhesive strength (N) | | | | | | |
| Before heating | 7.3 | 7.2 | 7.3 | 7.3 | 4.3 | 4.6 |
| After 5 days | 7.1 | 3.3 | 7.3 | 7.4 | 3.4 | 4.0 |
| After 20 days | 7.2 | 1.2 | 7.2 | 7.2 | 1.2 | 2.7 |

(Note) Thickness of the bonding layers are all 10 $\mu$m.

In Comparative Example 5 is used a melt-bonding coating containing a crystalline copolyamide having a very high relative viscosity of 1.7 and having a solid concentration of 19%. Since the viscosity of the coating is high, production of self-bonding insulated wires is difficult.

In Comparative Example 6, a melt-bonding coating containing the crystalline copolyamide having a relative viscosity of 1.7 is prepared to have a solid concentration of 14% and, therefore, the production of self-bonding insulated wires is possible. However, since the amount of a solvent in the coating is large, the produced self-bonding insulated wires have a large residual solvent content.

In Comparative Example 7, a crystalline copolyamide having a relative viscosity of 1.35 is used and, therefore, the coil prepared using the self-bonding insulated wire has a high initial strain and a low wire-wire adhesive force. Also the amount of change in neck diameter after heat treatment is large.

In Comparative Example 8, a non-crystalline copolyamide is used. The coil prepared using the self-bonding insulated wire has a high initial strain and a low wire-wire adhesive force. Also the amount of change in neck diameter after heat treatment is large.

In contrast, the results shown in Table 3 demonstrate that the melt-bonding coatings according to the present invention can be prepared to have a coatable viscosity even if the solid concentration is made high and, therefore, the obtained self-bonding insulated wire has a low residual solvent content, and that deflecting coils produced from the self-bonding insulated wires or self-bonding litz wires have a low initial strain, a high wire-wire adhesive strength and a good heat distortion resistance, and that the adhesive force does not substantially lower with the lapse of time.

Since a high-melting nylon is not used in Example 13, the initial strain of coil is high in its own way, but the residual solvent content is low and the wire-wire adhesive force tested at a high temperature with the lapse of time is also good.

Since an antioxidant is not used in Example 14, the wire-wire adhesive force of coil lowers with the lapse of time at a high temperature, but the residual solvent content of the wire is low and the initial strain of the coil is small.

As understood from the results shown in Table 2, the self-bonding insulated wires with a melt-bonding layer containing a specific crystalline copolyamide and the self-bonding litz wires according to the present invention would not introduce serious problems in odor and working environment, since the residual solvent content of the melt-bonding layer is low. Also, deflecting yoke coils prepared therefrom have a low initial strain, a good wire-wire adhesive force and a good heat distortion resistance.

As understood from the results shown in Table 3, the initial strain of coils can be further decreased by using the specific crystalline copolyamide in combination with a high-melting nylon, and the heat resistance of coils can be improved by using the specific crystalline copolyamide in combination with an antioxidant. Thus, in addition to the advantage of low residual solvent content, the self-bonding insulated wires and self-bonding litz wires of the present invention prepared using the specific crystalline copolyamide in combination with a high-melting nylon provide deflecting yoke coils having a small initial strain and good wire-wire adhesive force and heat distortion resistance. Also, the self-bonding insulated wires and self-bonding litz wires of the present invention prepared using the specific crystalline copolyamide in combination with an antioxidant provide deflecting yoke coils which do not substantially cause deterioration of wire-wire adhesive force even at high temperatures.

The self-bonding insulated wires and self-bonding litz wires of the present invention are industrially very useful.

What we claim is:

1. A self-bonding insulated wire having a bonding layer on an insulated wire, wherein said bonding layer is formed by applying and baking a coating comprising a crystalline copolyamide having a melting point within the range of 105 to 150° C. and a relative viscosity of 1.4 to 1.6 measured at 25° C. with respect to a 0.5% by weight m-cresol solution thereof, and the relative viscosity of a 0.5% by weight solution of said formed bonding layer dissolved in m-cresol is from 1.4 to 1.6 at 25° C.

2. The self-bonding insulated wire of claim 1, wherein said crystalline copolyamide has a relative viscosity of 1.47 to 1.57 measured at 25° C. with respect to a 0.5% by weight m-cresol solution thereof.

3. The self-bonding insulated wire of claim 1, wherein said crystalline copolyamide has a crystallization energy of not less than 10 J/g.

4. The self-bonding insulated wire of claim 1, wherein the residual solvent content of said bonding layer is not more than 0.8% by weight.

5. A self-bonding litz wire comprising the self-bonding insulated wire of claim 1, wherein a plurality of strands of said self-bonding insulated wire are stranded.

6. The self-bonding litz wire of claim 5, wherein the conductor of said self-bonding insulated wire has a diameter of 0.10 to 0.20 mm.

7. A self-bonding insulated wire having a bonding layer on an insulated wire, said bonding layer comprising a crystalline copolyamide having a melting point within the range of 105 to 150° C. and a relative viscosity of 1.4 to 1.6 measured at 25° C. with respect to a 0.5% by weight m-cresol solution thereof, and at least one member selected from the group consisting of a high-melting nylon having a melting point within the range of 200 to 300° C. and an antioxidant.

8. The self-bonding insulated wire of claim 7, wherein said crystalline copolyamide has a relative viscosity of 1.47 to 1.57 measured at 25° C. with respect to a 0.5% by weight m-cresol solution thereof.

9. The self-bonding insulated wire of claim 7, wherein said crystalline copolyamide has a crystallization energy of not less than 10 J/g.

10. The self-bonding insulated wire of claim 7, wherein the amount of said high-melting nylon is from 2 to 10 parts by weight per 100 parts by weight of said crystalline copolyamide.

11. The self-bonding insulated wire of claim 7, wherein said high-melting nylon is a member selected from the group consisting of nylon 66 and nylon 46.

12. The self-bonding insulated wire of claim 7, wherein the amount of said antioxidant is from 0.3 to 5 parts by weight per 100 parts by weight of the total of said crystalline copolyamide and said high-melting nylon.

13. The self-bonding insulated wire of claim 7, wherein said antioxidant is a phenolic antioxidant.

14. The self-bonding insulated wire of claim 7, wherein said antioxidant is N,N'-hexane-1,6-diylbis[3-(3,5-di-t-butyl-4-hydroxyphenyl)propionamide].

15. The self-bonding insulated wire of claim 7, wherein the residual solvent content of said bonding layer is not more than 0.8% by weight.

16. A self-bonding litz wire comprising the self-bonding insulated wire of claim 7, wherein a plurality of strands of said self-bonding insulated wire are stranded.

17. The self-bonding litz wire of claim 16, wherein the conductor of said self-bonding insulated wire has a diameter of 0.10 to 0.20 mm.

18. A self-bonding insulated wire having a bonding layer on an insulated wire, wherein said bonding layer comprises a crystalline copolyamide having a melting point within the range of 105 to 150° C. and the relative viscosity of a 0.5% by weight solution prepared by dissolving said bonding layer in m-cresol is from 1.4 to 1.6 at 25° C.

19. The self-bonding insulated wire of claim 18, wherein said crystalline copolyamide has a crystallization energy of not less than 10 J/g.

20. The self-bonding insulated wire of claim 18, wherein the residual solvent content of said bonding layer is not more than 0.8% by weight.

* * * * *